US011438690B2

(12) United States Patent
Han

(10) Patent No.: US 11,438,690 B2
(45) Date of Patent: Sep. 6, 2022

(54) VIBRATION GENERATING ELEMENT ASSEMBLY AND ELECTRONIC DEVICE INCLUDING THE SAME

(71) Applicant: Samsung Electronics Co., Ltd., Gyeonggi-do (KR)

(72) Inventor: Brian Han, Gyeonggi-do (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/892,534

(22) Filed: Jun. 4, 2020

(65) Prior Publication Data

US 2020/0396534 A1 Dec. 17, 2020

(30) Foreign Application Priority Data

Jun. 12, 2019 (KR) ..... 10-2019-0069253

(51) Int. Cl.
*H04R 1/28* (2006.01)
*H04R 1/02* (2006.01)
*H04R 7/16* (2006.01)

(52) U.S. Cl.
CPC ..... *H04R 1/288* (2013.01); *H04R 1/025* (2013.01); *H04R 7/16* (2013.01); *H04R 2499/15* (2013.01)

(58) Field of Classification Search
CPC ..... H04R 2499/11; H04R 2499/15; H04R 2460/13; H04R 1/028; H04R 1/02; H04R 1/025; H04R 1/288; H04R 1/026; H04R 1/2811; H04R 9/043; H04R 1/2876; H04R 1/2807; H04R 1/2869; H04R 1/2892
USPC ..... 381/190, 386, 151, 191, 162, 334, 322, 381/345, 365, 324, 353, 413, 71.2
See application file for complete search history.

(56) References Cited

U.S. PATENT DOCUMENTS 6,744,903 B1 * 6/2004 Jeon ..... G06F 1/1605 348/E5.13
2008/0219489 A1 9/2008 Yang et al.
2012/0308054 A1 * 12/2012 Chen ..... H04R 1/2811 381/162
2013/0010994 A1 * 1/2013 Liang ..... H04R 1/025 381/332

(Continued)

FOREIGN PATENT DOCUMENTS

KR 1020120053126 5/2012
KR 1020190020474 3/2019
KR 2019-0132732 A 11/2019

OTHER PUBLICATIONS

International Search Report dated Aug. 21, 2020 issued in counterpart application No. PCT/KR2020/006272, 3 pages.

*Primary Examiner* — Norman Yu
(74) *Attorney, Agent, or Firm* — The Farrell Law Firm, P.C.

(57) ABSTRACT

An electronic device includes a housing; a case including a first plate facing in a first direction, a second plate facing in a second direction opposite to the first direction, and a recess received in the housing and formed toward an inner space at an outer surface of the first plate or the second plate; an electronic element received in the case and configured to generate a vibration in an operation process; an anti-vibration member seated in the recess of the case and having an insertion hole formed in a center thereof; and a fixing protrusion protruded from an inner surface of the housing, having a latch jaw at an end portion, and inserted into and coupled to the insertion hole of the anti-vibration member.

19 Claims, 8 Drawing Sheets

(56) References Cited

U.S. PATENT DOCUMENTS

| | | | | |
|---|---|---|---|---|
| 2015/0201258 | A1 | 7/2015 | Han et al. | |
| 2018/0198052 | A1* | 7/2018 | Park | G06F 3/016 |
| 2019/0356983 | A1 | 11/2019 | Han et al. | |

* cited by examiner

VIBRATION GENERATING ELEMENT ASSEMBLY AND ELECTRONIC DEVICE INCLUDING THE SAME

CROSS-REFERENCE TO RELATED APPLICATIONS

This application is based on and claims priority under 35 U.S.C. § 119 to Korean Patent Application No. 10-2019-0069253, filed on Jun. 12, 2019, in the Korean Intellectual Property Office, the disclosure of which is incorporated by reference herein in its entirety.

BACKGROUND

1. Field

The present disclosure relates generally to a vibration generating element assembly that can block a vibration from being transferred.

2. Description of Related Art

The design of electronic devices is gradually becoming slimmer and lighter, and electronic devices are becoming more complex as they provide more functions.

In order to provide various functions, such electronic devices may be equipped with various elements having large and small sizes. Among the elements, an element that generates a vibration may be mounted, and unlike other elements, the mounting of such an element may require measures for anti-vibration.

As electronic devices gradually become thinner, research on a coupling structure that can achieve a dust-proof effect while occupying a small space in a process of reducing an internal space is being actively conducted.

Conventionally, in coupling a vibration generating element assembly to an electronic device, additional elements such as a separate dedicated screw for coupling the vibration generating element assembly have been needed. Further, when assembling the elements using the screw, a time of an assembly process may increase. Additionally, it may be difficult to position and the elements inside the electronic device due to an area consumed by the volume of the screws.

Further, it may be important to secure a resonance space of a sound in an electronic element such as a speaker, and by completely penetrating a case of the vibration generating element assembly, when the electronic element is coupled to a housing of the electronic device, using an inner space of the case as a resonance space may be compromised due to the penetration of the case.

SUMMARY

The present disclosure has been made to address the above-mentioned problems and disadvantages, and to provide at least the advantages described below.

In accordance with an aspect of the disclosure, a vibration generating element assembly includes an electronic element configured to generate a vibration in an operation process; a case including a first plate facing in a first direction and a second plate facing in a second direction opposite to the first direction, and a recess configured to receive the electronic element and formed toward the inner space at an outer surface of the first plate or the second plate; and an anti-vibration member seated in the recess of the case, having an insertion hole in a center thereof, and coupled to a fixing protrusion of the electronic device.

In accordance with another aspect of the disclosure, an electronic device includes a housing; a case including a first plate facing in a first direction, a second plate facing in a second direction opposite to the first direction, and a recess received in the housing and formed toward an inner space at an outer surface of the first plate or the second plate; an electronic element received in the case and configured to generate a vibration in an operation process; an anti-vibration member seated in the recess of the case and having an insertion hole formed in a center thereof; and a fixing protrusion protruded from an inner surface of the housing, having a latch jaw at an end portion, and inserted into and coupled to the insertion hole of the anti-vibration member.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
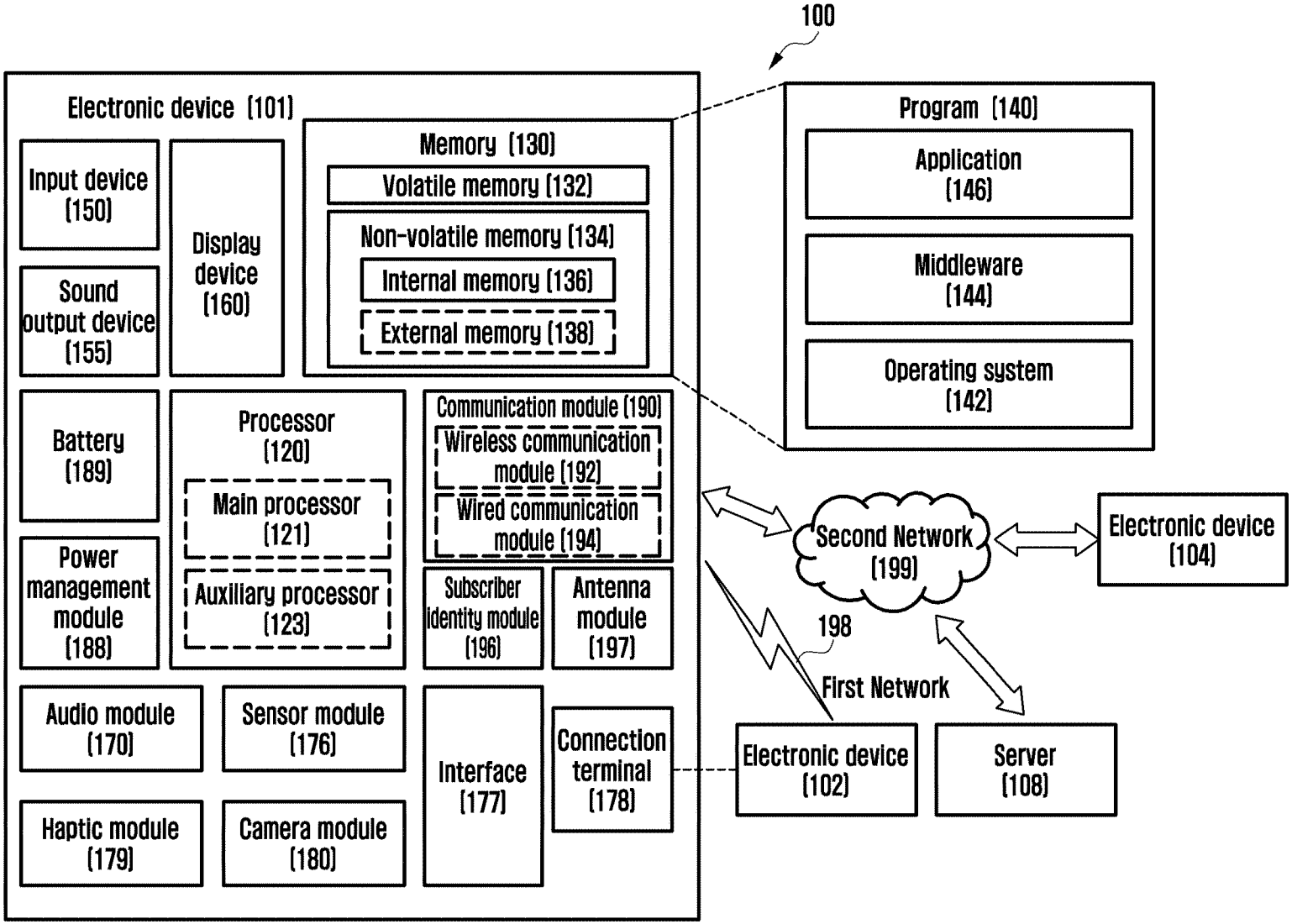
FIG. 1 is a block diagram illustrating a configuration of an electronic device in a network environment, according to an embodiment.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network), According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, ISPs, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
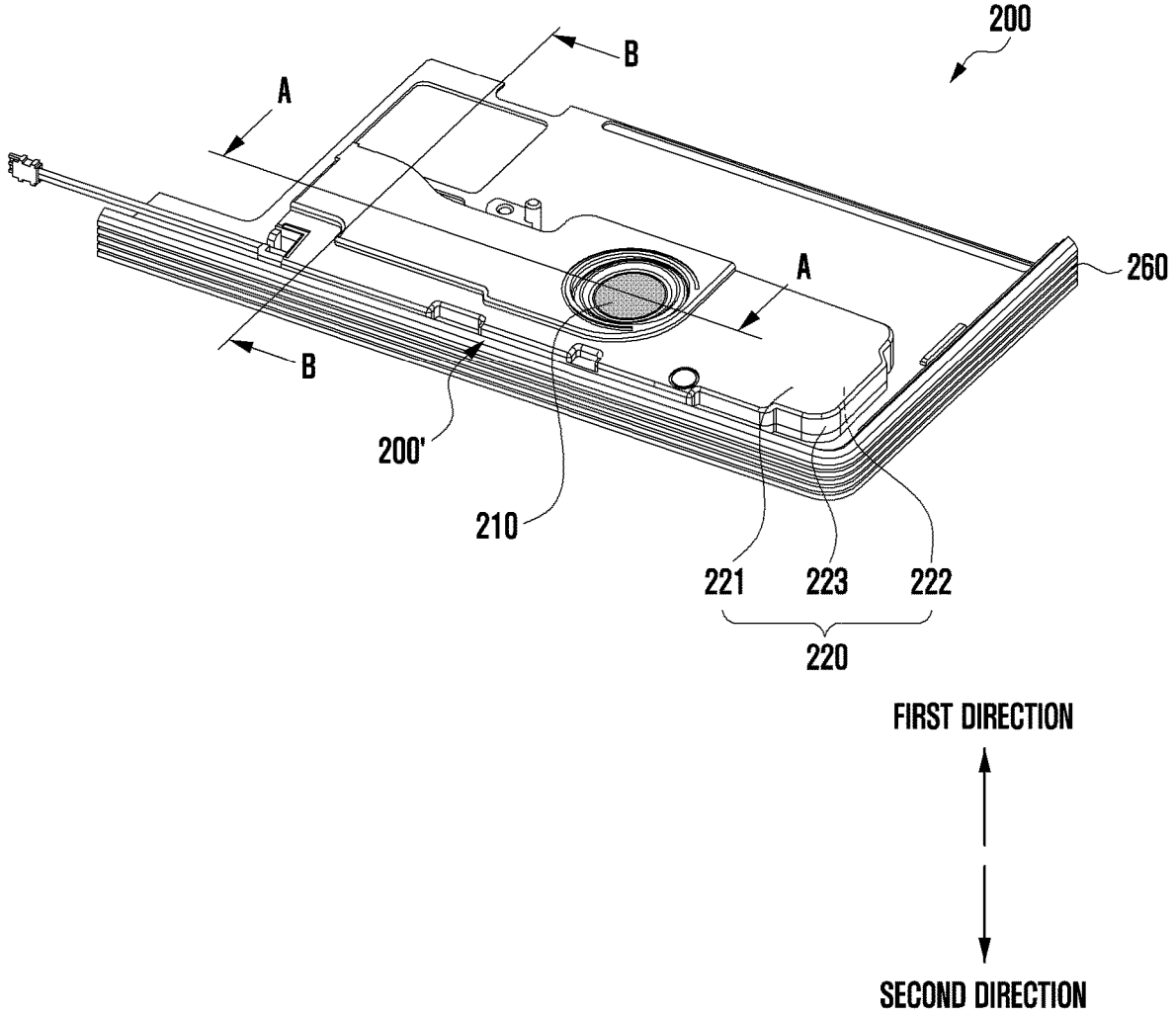
FIG. 2 is a perspective view illustrating an electronic device including a vibration generating element assembly, according to an embodiment.

FIG. 2 is a perspective view illustrating an electronic device 200 including a vibration generating element assembly 200', according to an embodiment.

Referring to FIG. 2, the electronic device 200 includes a housing 260, a fixing protrusion 240 (see FIG. 7), and a vibration generating element assembly 200'.

The housing 260 may be a basic skeleton that receives the vibration generating element assembly 200' and forms an external shape of all or some of the electronic device 200. For example, the housing 260 may form an external shape of the electronic device 200 such as a mobile terminal, a tablet personal computer (PC), or a laptop computer. The housing 260 may receive various elements such as a display, a printed circuit board, and an input device (e.g., a keyboard or a touch pad).

The fixing protrusion 240 (see FIG. 7) may protrude from a surface of the housing 260 and may serve to couple the vibration generating element assembly 200' to the housing 260. The fixing protrusion 240 may be formed integrally with the housing 260 or may be separate from the housing 260 so as to be coupled to the housing 260. The fixing protrusion 240 may not be exposed after being coupled to the vibration generating element assembly 200'.

The fixing protrusion 240 may be inserted into a bracket seated inside the housing 260. Similarly, the fixing protrusion 240 may not be exposed after being coupled to the vibration generating element assembly 200'.

Figure 3:
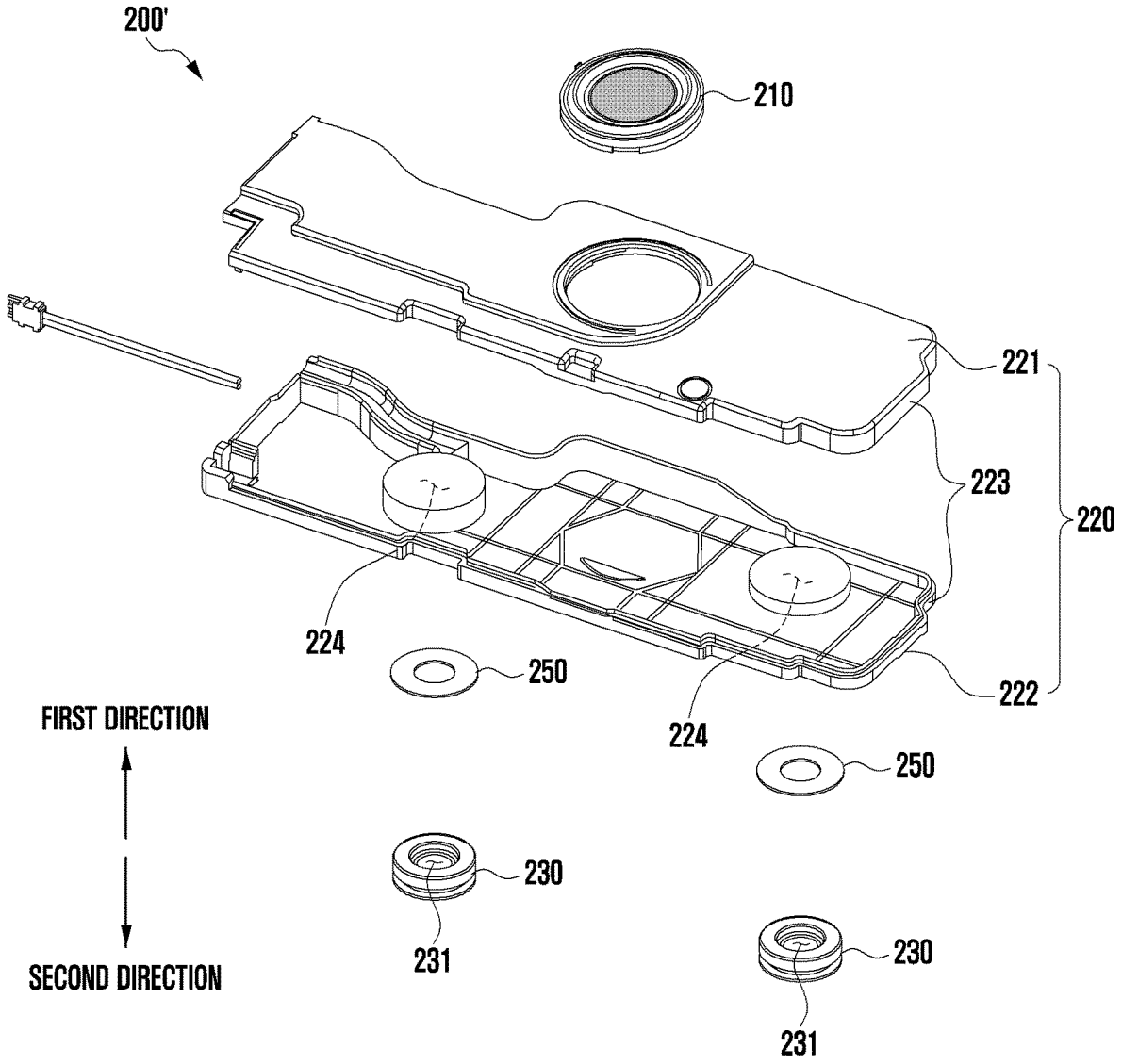
FIG. 3 is an exploded perspective view illustrating a vibration generating element assembly, according to an embodiment.
Figure 4:
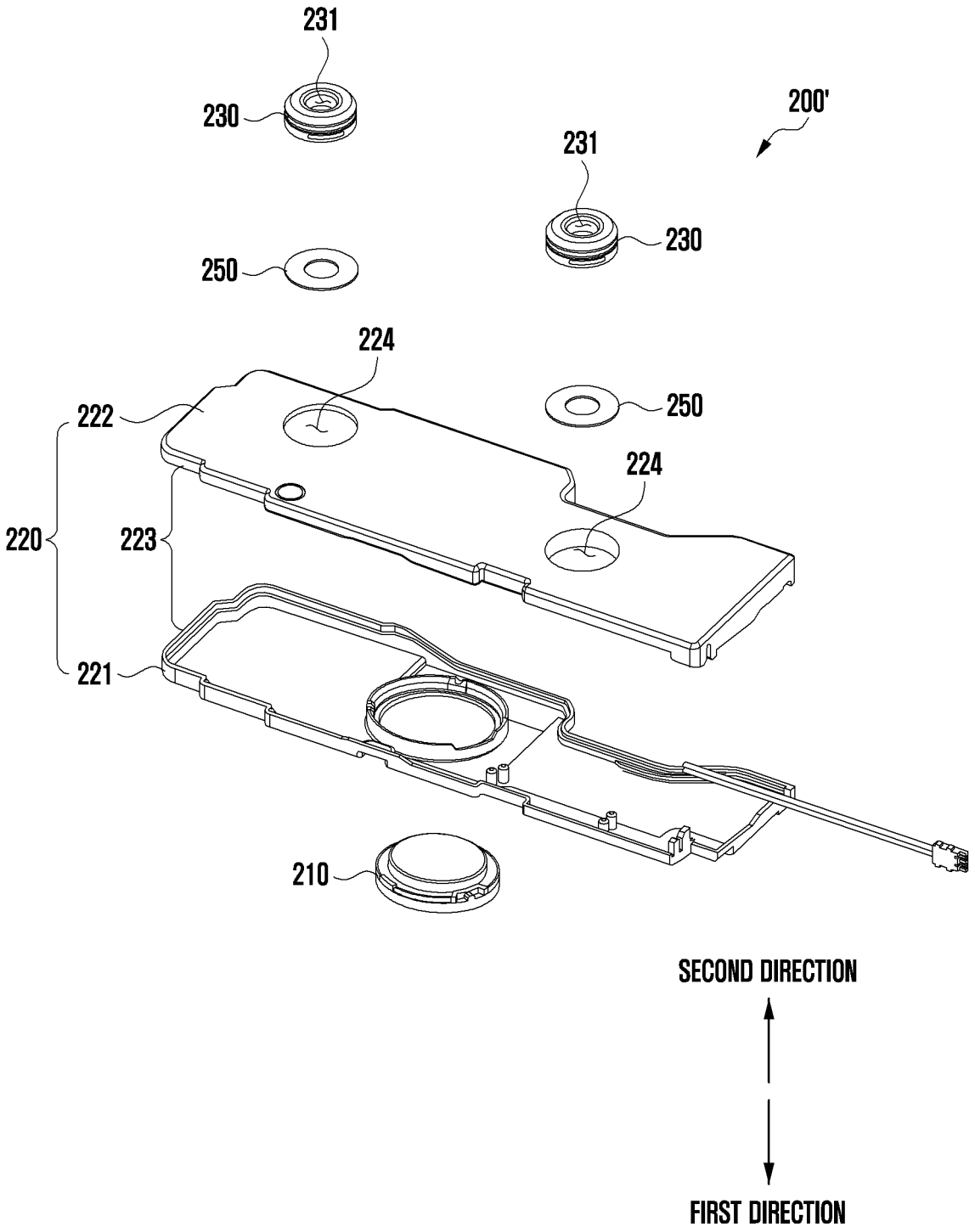
FIG. 4 is an exploded perspective view illustrating a vibration generating element assembly in a direction, according to an embodiment.

FIG. 3 is an exploded perspective view illustrating a vibration generating element assembly 200', according to an embodiment, and FIG. 4 is an exploded perspective view illustrating a vibration generating element assembly 200' in another direction, according to an embodiment.

Referring to FIGS. 3-4, the vibration generating element assembly 200' includes an electronic element 210, a case 220, and/or an anti-vibration member 230. The anti-vibration member 230 may be made of rubber or silicon.

The vibration generating element assembly 200' may be used when coupling the electronic element 210 in which a vibration occurs in an operation process to the electronic device 200. The vibration generating element assembly 200' may block a vibration generated in the electronic element 210 from being transferred to other elements of the electronic device 200.

The electronic element 210 is an element in which a vibration occurs in an operation process, such as a speaker. The electronic element 210 may be received in the case 220, and at least a portion thereof may be exposed through a surface of the case 220.

The case 220 may include a first plate 221 facing in a first direction and a second plate 222 facing in a second direction opposite to the first direction. The case 220 may include a side member 223 formed to enclose a space between the first plate 221 and the second plate 222.

For example, as illustrated in FIG. 3, the first direction represents upward and the second direction represents downward. The case 220 is not limited to the first plate 221, the second plate 222, and the side member 223. For example, as illustrated in FIG. 3, the side member 223 is integrally formed with the first plate 221 or the second plate 222, such that the side member 223 may be formed as an upper case including the first plate 221 and a lower case including the second plate 222.

A recess 224 may be formed in the case 220. The recess 224 may be formed to be recessed toward an inner space but not to penetrate an inner space at an outer surface of either the first plate 221 or the second plate 222. The anti-vibration member 230 may be seated in the recess 224. The anti-vibration member 230 may be fixed to the recess 224 through various methods. For example, as illustrated in FIGS. 3 to 4, the anti-vibration member 230 is coupled through an adhesive member 250. The adhesive member 250 may be a double-sided tape, a member to which an adhesive is applied, or a bond.

The anti-vibration member 230 may couple the vibration generating element assembly 200' to the housing 260 of the electronic device 200 and be made of an elastic material to block or absorb a vibration generated in the electronic element 210 (e.g., speaker) from being transferred to the electronic device 200. An insertion hole 231 may be formed at the center of the anti-vibration member 230. The fixing protrusion 240 (see FIG. 7) formed in the housing 260 (see FIG. 7) may be inserted into the insertion hole 231 to couple the vibration generating element assembly 200' to the housing 260.

Figure 5:
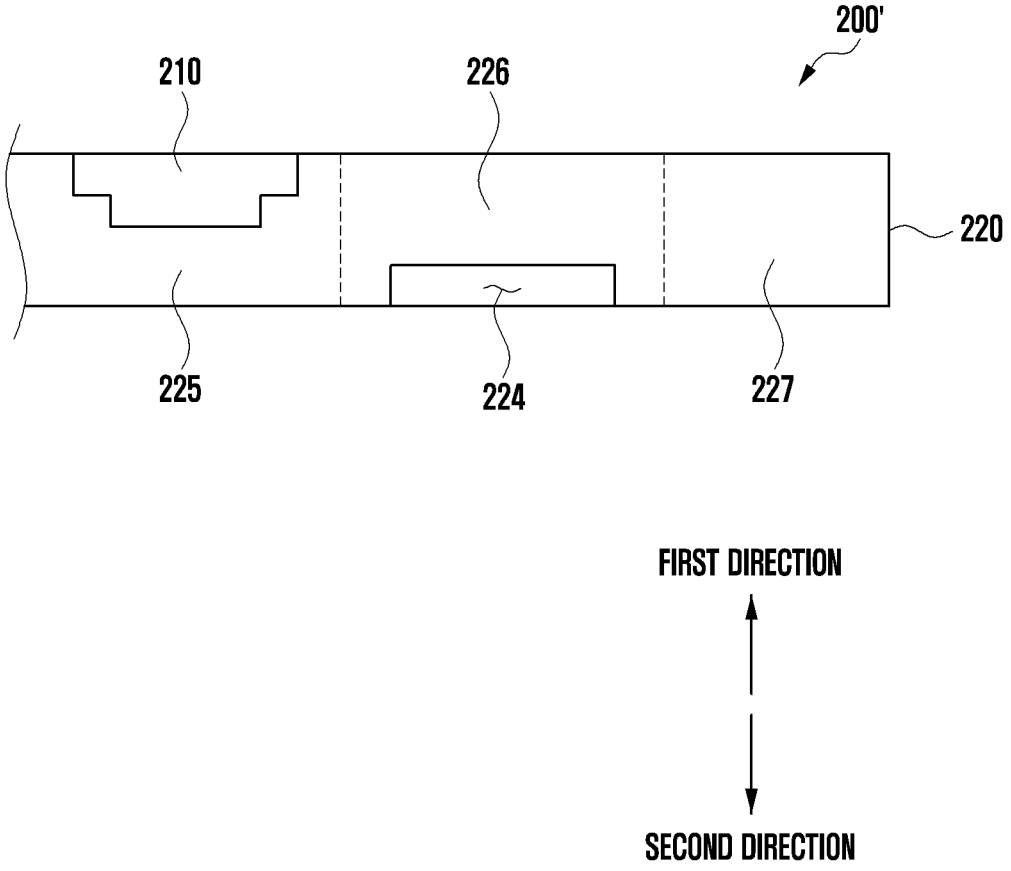
FIG. 5 is a diagram conceptually illustrating a cross section of the electronic device taken along line A-A of FIG. 2, according to an embodiment.

FIG. 5 is a diagram conceptually illustrating a cross section of the electronic device taken along line A-A of FIG.

2, according to an embodiment. FIG. 5 is a diagram illustrating one end (e.g., left end) of the case 220 (see FIG. 2) cut about the electronic element 210 (e.g., speaker) of FIG. 2 and an inner space to the other end (e.g., right end) about the electronic element 210 may be the same or similar.

Referring to FIG. 5, an inner space of the case 220 includes a first inner space 225, a second inner space 226, and a third inner space 227.

The first inner space 225, the second inner space 226, and the third inner space 227 may be random spaces obtained by roughly cutting and dividing the case 220 of the vibration generating element assembly 200' in relation to the elements. Thus, the first inner space 225, the second inner space 226, and the third inner space 227 may not be physically separated spaces through structures, such as partitions.

The first internal space 225 may be a space in which the electronic element 210 is mainly formed. More specifically, the first internal space 225 may mean a space between the electronic element 210 and the first plate 221 or the second plate 222.

The second inner space 226 may be a space in which the recess 224 is mainly formed. More specifically, the second inner space 226 may mean a space between a bottom surface of the recess 224 and the first plate 221 or the second plate 222.

The third internal space 227 may be a space formed with the second internal space 226 interposed therebetween in relation with the first internal space 225 and may be an internal space formed adjacent to the outer side of the case 220.

The recess 224 for coupling the anti-vibration member 230 is located in the second inner space 226, but when a hole having a penetrated shape is located in the second inner space 226 instead of the recess 224, the first inner space 225 and the third inner space 227 may be disconnected based on the state illustrated in FIG. 5. The first inner space 225 and the third inner space 227 may be connected in a direction (e.g., a direction of protrusion or recession in FIG. 5) perpendicular to the cross-sectional view of FIG. 5, but the hole may distort a sound generated in the electronic element 210 (e.g., speaker) or may not substantially use the third internal space 227. Therefore, the vibration generating element assembly 200' may have a coupling portion of the anti-vibration member 230 in the form of the recess 224. Thus, the first inner space 225 and the third inner space 227 may be connected in the first direction or the second direction.

Figure 6:
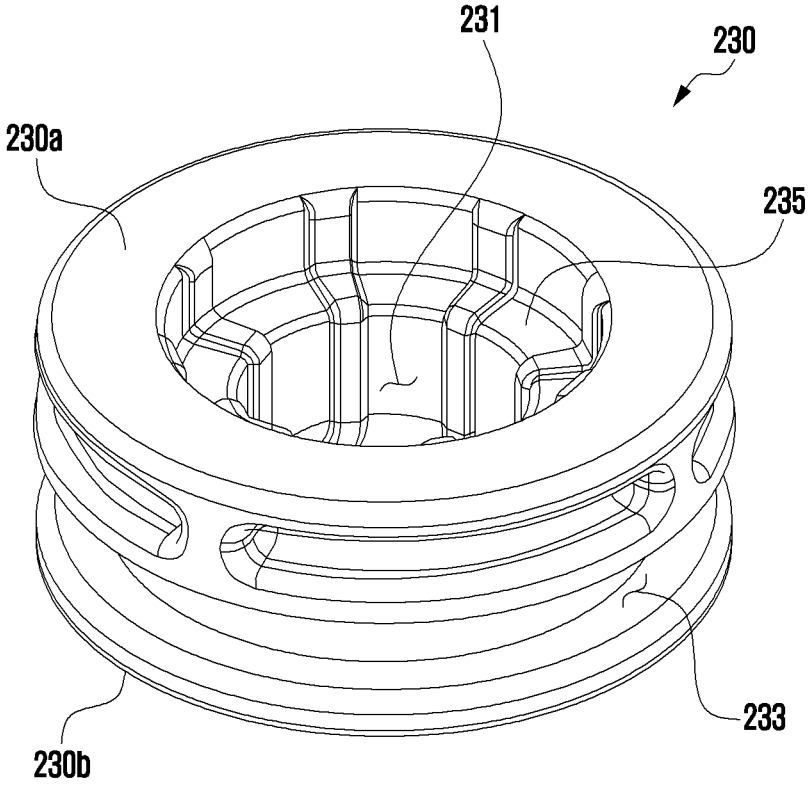
FIG. 6 is a perspective view illustrating an anti-vibration member, according to an embodiment.

FIG. 6 is a perspective view illustrating an anti-vibration member 230, according to an embodiment.

Referring to FIG. 6, the anti-vibration member 230 has an insertion hole 231 at the center thereof in a cylindrical shape. The anti-vibration member 230 may be formed in a cylindrical shape, a polygonal column shape, or another column shape. A coupling groove 233 may be formed at an outer circumferential surface of the anti-vibration member 230. The coupling groove 233 may be recessed in a center direction from an outer peripheral surface of the anti-vibration member 230 and may be fitted to a rib 261 formed in the case 220 of the vibration generating element assembly 200' such that the adhesive member 250 for coupling the anti-vibration member 230 to the case 220 may be unnecessary.

A periphery of the insertion hole 231 may be recessed at one side end surface 230*a* of the anti-vibration member 230 to form a latch groove 235. A diameter of the latch groove 235 may be formed to correspond to a diameter of a latch jaw 241 (see FIG. 7) of the fixing protrusion 240 (see FIG. 7), and a depth of the latch groove 235 may be formed to correspond to a height of the latch jaw 241 of the fixing protrusion 240. The other side end surface 230*b* of the anti-vibration member 230 may be in a direction facing toward the fixing protrusion 240.

Figure 7:
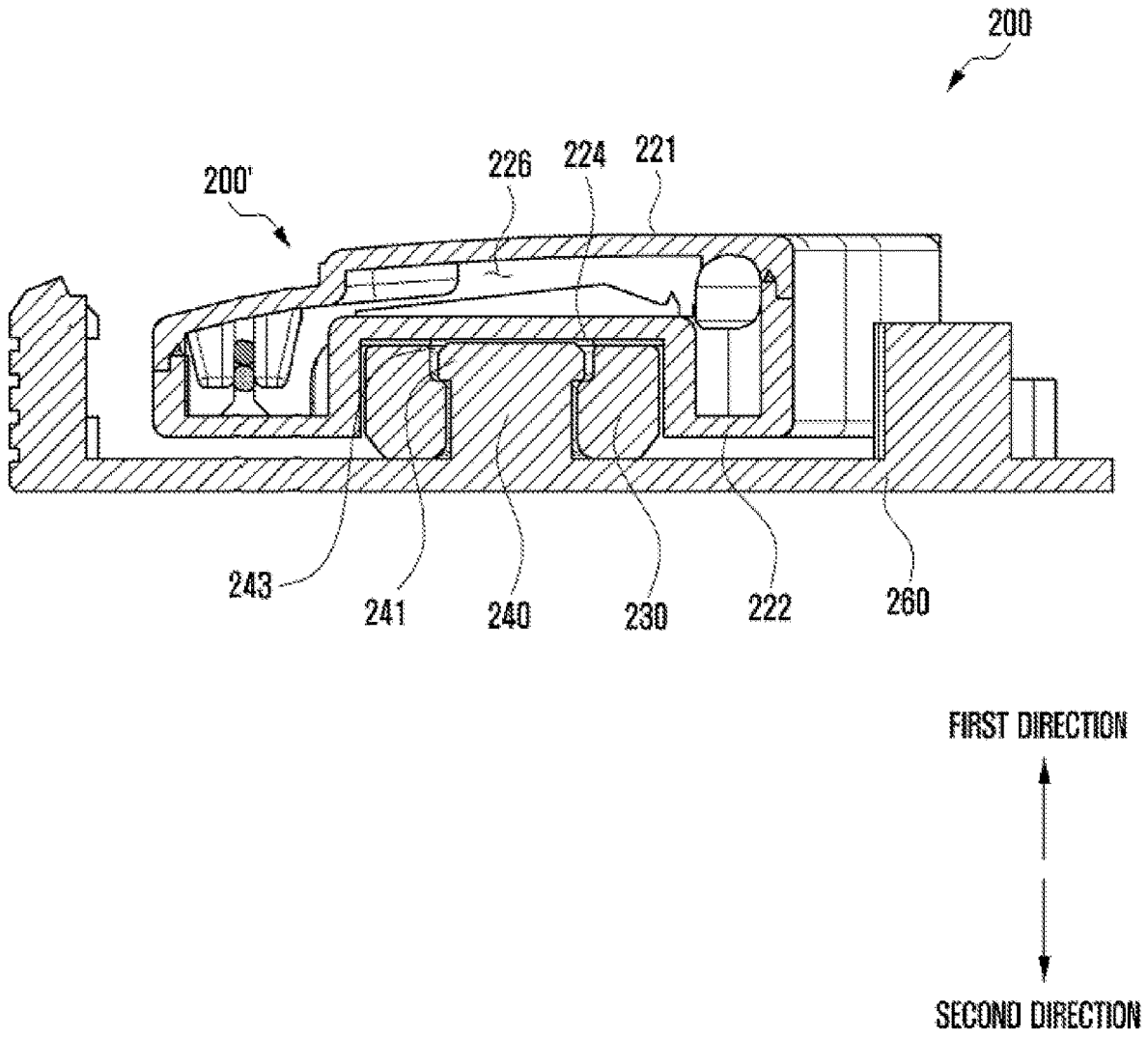
FIG. 7 is a cross-sectional view illustrating the electronic device taken along line B-B of FIG. 2, according to an embodiment.

FIG. 7 is a cross-sectional view illustrating the electronic device taken along line B-B of FIG. 2, according to an embodiment. More specifically, FIG. 7 may be a cross-sectional view of a portion in which a vibration generating element assembly 200' is coupled to the fixing protrusion 240 of the housing 260, and may be a cross-sectional view of the second inner space 226 of a case 220.

Referring to FIG. 7, the fixing protrusion 240 is protruded from a surface of the housing 260, and a latch jaw 241 is formed at the protruded end. The latch jaw 241 may be formed larger than a diameter of the insertion hole 231 of the anti-vibration member 230. Thus, it may be difficult for the anti-vibration member 230 to be separated after being inserted into the fixing protrusion 240. An edge of the end of the latch jaw 241 may be chamfered 243 so that the anti-vibration member 230 may be easily inserted into and coupled to the fixing protrusion 240.

The fixing protrusion 240 may be a power entry module (PEM) nut or a self-cinching nut. The PEM nut is not necessarily in the form of a nut but may be in the form of a simple protrusion. The PEM nut may be a name for a form of an element, such as a protrusion used for coupling to a thin metal sheet, or a soft or non-soft sheet through a method such as press-fitting, broaching, or surface mounting. Further, because the PEM nut may be produced in various shapes, the PEM nut may be easily modified and used according to an application target.

By forming a second inner space 226 in the inner space of the case 220, it is possible to additionally secure a resonance space corresponding to the volume of the second inner space 226 and by connecting the first inner space 225 and the third inner space 227 in the first direction or the second direction through the second inner space 226, utilization of the third inner space 227 as a resonance space can be increased.

Figure 8:
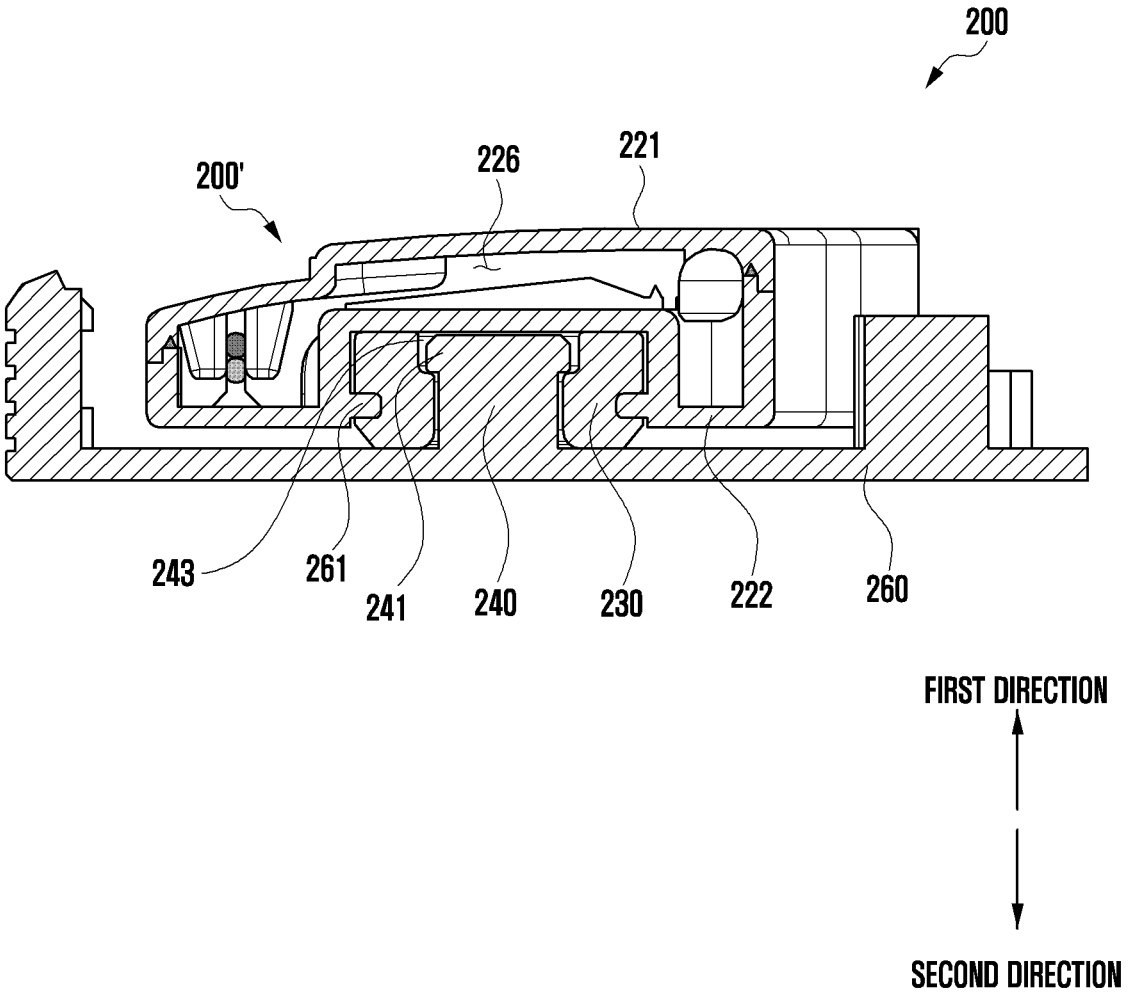
FIG. 8 is a cross-sectional view illustrating the electronic device taken along line B-B of FIG. 2, according to another embodiment.

FIG. 8 is a cross-sectional view illustrating the electronic device taken along line B-B of FIG. 2, according to an embodiment.

In describing the electronic device 200 of FIG. 8, for conciseness, similar elements to the embodiment of FIG. 7 may not be described. The anti-vibration member 230 may be coupled by fitting the coupling groove 233 into the rib 261 formed in the recess 224 of the vibration generating element assembly 200'. The dust-proof member 230 can be coupled to the recess 224 without a separate attachment member.

A vibration generating element assembly 200' may include an electronic element 210 configured to generate a vibration in an operation process; a case 220 including a first plate 221 facing in a first direction and a second plate 222 facing in a second direction opposite to the first direction, and a recess 224 configured to receive the electronic element 210 and formed toward the inner space at an outer surface of the first plate 221 or the second plate 222; and an anti-vibration member 230 seated in the recess 224 of the case 220, having an insertion hole 231 in a center thereof, and coupled to a fixing protrusion 240 of the electronic device 200.

The inner space of the case 220 may include a first inner space 225 formed between the electronic element 210 and any one of the first plate 221 or the second plate 222; a second inner space 226 formed between the recess 224 and any one of the first plate 221 or the second plate 222; and a third internal space 227 formed with the second internal space 226 interposed therebetween in relation to the first internal space 225, wherein the first inner space 225 to the third inner space 227 may be in communication.

The anti-vibration member 230 may be made of an elastic material.

The anti-vibration member 230 may be seated in the recess 224 of the case 220, and be fixed by the adhesive member 250.

The anti-vibration member 230 may have a column shape and have a coupling groove 233 along an outer circumferential surface of the anti-vibration member 230.

The anti-vibration member 230 may include a latch groove 235 formed at a one side end surface thereof and recessed along the insertion hole 231 in a portion of the one side end surface.

A portion connected to the insertion hole 231 at another side end surface of the anti-vibration member 230 may be continuously formed with a predetermined curvature.

The electronic element 210 may be a speaker and at least a portion thereof may be exposed through any one of the first plate 221 or the second plate 222.

The recess 224 may be formed in a direction opposite to that in which the electronic element 210 is exposed.

An electronic device 200 according to an embodiment of the disclosure may include a housing 260; a case 220 including a first plate 221 facing in a first direction, a second plate 222 facing in a second direction opposite to the first direction, and a recess 224 received in the housing 260 and formed toward an inner space at an outer surface of the first plate 221 or the second plate 222; an electronic element 210 received in the case 220 and configured to generate a vibration in an operation process; an anti-vibration member 230 seated in the recess 224 of the case 220 and having an insertion hole 231 formed in a center thereof; and a fixing protrusion 240 protruded from an inner surface of the housing 260, having a latch jaw 241 at an end portion, and inserted into and coupled to the insertion hole 231 of the anti-vibration member 230.

The inner space of the case 220 may include a first inner space 225 formed between the electronic element 210 and any one of the first plate 221 or the second plate 222; a second inner space 226 formed between the recess 224 and any one of the first plate 221 or the second plate 222; and a third internal space 227 formed with the second internal space 226 interposed therebetween in relation to the first internal space 225, wherein the first inner space 225 to the third inner space 227 may be in communication.

The anti-vibration member 230 may be made of an elastic material.

The anti-vibration member 230 may be seated in the recess 224 of the case 220, and be fixed by the adhesive member 250.

The anti-vibration member 230 may have a column shape and have a coupling groove 233 formed along an outer circumferential surface of the anti-vibration member 230.

The anti-vibration member 230 may include a latch groove 235 formed at one side end surface thereof, recessed along the insertion hole 231 in a portion of the one side end surface, and formed to correspond to a shape of the latch jaw 241.

The fixing protrusion 240 may have a cylindrical shape and be formed to correspond to a diameter of an insertion hole 231 of the anti-vibration member 230, and the latch jaw 241 may be protruded from an inner surface of the housing 260, and at the end of the latch jaw 241, a diameter of the cylinder may be extended to be larger than a diameter of the insertion hole 231 of the anti-vibration member 230.

A portion connected to the insertion hole 231 at another side end surface of the anti-vibration member 230 may be continuously formed with a predetermined curvature, and an edge of the end of the latch jaw 241 may be chamfered.

A depth of the latch groove 235 may correspond to a thickness of the latch jaw 241.

The electronic element 210 may be a speaker, and at least a portion thereof may be exposed through any one of the first plate 221 or the second plate 222.

The recess 224 may be formed in a direction opposite to that in which the electronic element 210 is exposed.

In coupling a vibration generating element assembly to an electronic device, it is possible to provide a vibration generating element assembly and an electronic device including the same, which can quickly assemble without a separate additional element such as a screw.

By reducing a thickness occupied by the vibration generating element assembly, a slimmer electronic device can be provided.

By preventing a hole from penetrating the vibration generating element assembly and coupling an anti-vibration member through a recess, an internal space may be better suited to be used as a resonance space.

While the present disclosure has been particularly shown and described with reference to certain embodiments thereof, it will be understood by those of ordinary skill in the art that various changes in form and details may be made therein without departing from the spirit and scope of the disclosure as defined by the appended claims and their equivalents.

What is claimed is:

1. A vibration generating element assembly, comprising:

an electronic element configured to generate a vibration in an operation process;

a case comprising a first plate facing in a first direction and a second plate facing in a second direction opposite to the first direction, wherein the electronic element is positioned in an inner space of an outer surface of the first plate; and an anti-vibration member seated in a recess formed in an inner space of an outer surface of the first plate or an inner space of an outer surface of the second plate, the anti-vibration member having an insertion hole in a center thereof, and coupled to a fixing protrusion of the vibration generating element assembly, wherein the fixing protrusion protrudes from an inner surface of a housing of the electronic device, the fixing protrusion has a latch jaw at an end portion and inserts into the insertion hole of the anti-vibration member, wherein the fixing protrusion has a cylindrical shape and is formed to correspond to a diameter of the insertion hole of the anti-vibration member, and wherein at the end of the latch jaw, a diameter of the cylinder is extended to be larger than the diameter of the insertion hole of the anti-vibration member.

2. The vibration generating element assembly of claim 1, wherein the inner space of the case comprises:

a first inner space formed between the electronic element and any one of the first plate or the second plate;

a second inner space formed between the recess and any one of the first plate or the second plate; and a third internal space formed with the second internal space interposed therebetween in relation to the first internal space, wherein the first inner space to the third inner space are in communication.

3. The vibration generating element assembly of claim 2, wherein the anti-vibration member is made of an elastic material.

4. The vibration generating element assembly of claim 3, wherein the anti-vibration member is seated in the recess of the case and is fixed by an adhesive member.

5. The vibration generating element assembly of claim 3, wherein the anti-vibration member has a column shape and has a coupling groove along an outer circumferential surface of the anti-vibration member.

6. The vibration generating element assembly of claim 5, wherein the anti-vibration member comprises a latch groove formed at a one side end surface thereof and recessed along an insertion hole in a portion of the one side end surface.

7. The vibration generating element assembly of claim 6, wherein a portion connected to the insertion hole at another side end surface of the anti-vibration member is continuously formed with a predetermined curvature.

8. The vibration generating element assembly of claim 6, wherein the electronic element is a speaker and at least a portion thereof is exposed through any one of the first plate or the second plate.

9. The vibration generating element assembly of claim 8, wherein the recess is formed in a direction opposite to that in which the electronic element is exposed.

10. An electronic device, comprising:

a housing;

a case comprising a first plate facing in a first direction, a second plate facing in a second direction opposite to the first direction;

an electronic element received in the case and configured to generate a vibration in an operation process, wherein the electronic element is positioned in an inner space of an outer surface of the first plate;

an anti-vibration member seated in a recess formed in an inner space of an outer surface of the first plate or an inner space of an outer surface of the second plate, the anti-vibration member having an insertion hole formed in a center thereof; and a fixing protrusion protruded from an inner surface of the housing, having a latch jaw at an end portion, and inserted into and coupled to the insertion hole of the anti-vibration member, wherein the fixing protrusion has a cylindrical shape and is formed to correspond to a diameter of the insertion hole of the anti-vibration member, and wherein at the end of the latch jaw, a diameter of the cylinder is extended to be larger than the diameter of the insertion hole of the anti-vibration member.

11. The electronic device of claim 10, wherein the inner space of the case comprises:

a first inner space formed between the electronic element and any one of the first plate or the second plate;

a second inner space formed between the recess and any one of the first plate or the second plate; and a third internal space formed with the second internal space interposed therebetween in relation to the first internal space, wherein the first inner space to the third inner space are in communication.

12. The electronic device of claim 11, wherein the anti-vibration member is made of an elastic material.

13. The electronic device of claim 12, wherein the anti-vibration member is seated in the recess of the case and is fixed by an adhesive member.

14. The electronic device of claim 12, wherein the anti-vibration member has a column shape and has a coupling groove formed along an outer circumferential surface of the anti-vibration member.

15. The electronic device of claim 14, wherein the anti-vibration member comprises a latch groove formed at one side end surface thereof, recessed along the insertion hole in a portion of the one side end surface, and formed to correspond to a shape of the latch jaw.

16. The electronic device of claim 10, wherein a portion connected to the insertion hole at another side end surface of the anti-vibration member is continuously formed with a predetermined curvature, and an edge of the end of the latch jaw is chamfered.

17. The electronic device of claim 16, wherein a depth of the latch groove corresponds to a thickness of the latch jaw.

18. The electronic device of claim 17, wherein the electronic element is a speaker, and at least a portion thereof is exposed through any one of the first plate or the second plate.

19. The electronic device of claim 18, wherein the recess is formed in a direction opposite to that in which the electronic element is exposed.

* * * * *